US006394871B2

(12) United States Patent
Lee

(10) Patent No.: US 6,394,871 B2
(45) Date of Patent: May 28, 2002

(54) METHOD FOR REDUCING EMITTER TIP TO GATE SPACING IN FIELD EMISSION DEVICES

(75) Inventor: Ji Ung Lee, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/945,510

(22) Filed: Aug. 30, 2001

Related U.S. Application Data

(62) Division of application No. 09/145,595, filed on Sep. 2, 1998.

(51) Int. Cl.[7] ..... H01J 9/02; H01J 1/304
(52) U.S. Cl. ..... 445/24
(58) Field of Search ..... 445/24, 50

(56) References Cited

U.S. PATENT DOCUMENTS 4,943,343 A * 7/1990 Bardai et al. ..... 445/24
5,229,331 A * 7/1993 Doan et al. ..... 445/50
5,259,799 A 11/1993 Doan et al. ..... 445/24
5,653,619 A 8/1997 Cloud et al. ..... 445/24
5,675,210 A 10/1997 Kim ..... 313/309
6,232,705 B1 5/2001 Forbes et al. ..... 313/309

OTHER PUBLICATIONS

Ting, C.Y., "Study of planarized sputter–deposited SiO2", *J. Vac. Sci. Technol,* 15(3), pp. 1105–1112, (May/Jun. 1978).

* cited by examiner

*Primary Examiner*—Kenneth J. Ramsey
(74) *Attorney, Agent, or Firm*—Schwegman, Lundberg, Woessner & Kluth, P.A.

(57) ABSTRACT

An improved structure and method are provided to decouple the gate dielectric thickness and the emitter tip to gate layer distance by etching the dielectric using ion bombardment. The ion bombardment, or ion etch, is performed prior to depositing the gate layer. The improved structure and method will allow a smaller distance between the emitter tip and the gate structure without having to decrease the thickness of the gate insulator layer. The smaller emitter tip to gate distance lowers the turn-on voltage which is highly desirable in such areas as beam optics and power dissipation.

35 Claims, 4 Drawing Sheets

METHOD FOR REDUCING EMITTER TIP TO GATE SPACING IN FIELD EMISSION DEVICES

This application is a Divisional of U.S. Application Ser. No. 09/145,595, filed Sep. 2, 1998.

FIELD OF THE INVENTION

The present invention relates generally to semiconductor integrated circuits. More particularly, it pertains to a structure and method for reduced emitter tip to gate spacing in field emission devices.

BACKGROUND OF THE INVENTION

Recent years have seen an increased interest in field emission devices. This is attributable to the fact that such displays can fulfill the goal of consumer affordable hang-on-the-wall flat panel television displays with diagonals in the range of 20 to 60 inches. Certain field emission devices, or flat panel displays, operate on the same physical principle as fluorescent lamps. A gas discharge generates ultraviolet light which excites a phosphor layer that fluoresces visible light. Other field emission devices operate on the same physical principles as cathode ray tube (CRT) based displays. Excited electrons are guided to a phosphor target to create a display. Silicon-based field emitter arrays are one source for creating similar displays.

Single crystalline silicon structures have been under investigation for some time for use in fabricating field emission devices. However, large area, TV size, displays are likely to be expensive and difficult to manufacture from single crystal silicon wafers. Polycrystalline silicon, on the other hand, provides a viable substitute to single crystal silicon since it can be deposited over large areas on glass or other substrates.

The resolution of a field emission display is a function of a number of factors, including emitter tip sharpness, alignment and spacing of the gates, or grid openings, which surround the tips. One of the key issues in the development of field emission devices (FEDs) is the emitter tip to gate distance. This distance partly determines the turn-on voltage, the voltage difference required between the tip and the grid to start emitting electrons. Typically, the smaller the distance, the lower the turn-on voltage for a given field emitter, and hence lower power dissipation. A low turn-on voltage also improves the beam optics. Thus it is desirable to minimize the, emitter tip to gate distance in the development of field emission devices (FED).

There are numerous methods to fabricate FEDs. One such popular technique in the industry includes the "Spindt" method, named after an early patented process. Spindt, et. al. discuss field emission cathode structures in U.S. Pat. Nos. 3,665,241, 3,755,704, and 3,812,559. Generally, the Spindt technique entails the conventional steps of masking insulator layers and then includes lengthy etching, oxidation, and deposition steps. In the push for more streamlined fabrication processes, the Spindt method is no longer the most efficient approach. Moreover, the Spindt process does not resolve or necessarily address the problem of gate to emitter tip distance.

The emitter tip to gate spacing is generally determined by the thickness of the dielectric layer in place between the two. One method of achieving a smaller emitter tip to gate distance is to deposit a thinner dielectric, or insulator layer. However, this approach has the negative consequence of increasing the capacitance between the gate and substrate regions. In turn, the increased capacitance increases the response time of the field emission device.

A more recent technique includes the use of chemical mechanical planarization (CMP) and an insulator reflow step. One such method is presented in U.S. Pat. No. 5,229,331, entitled "Method to Form Self-Aligned Gate Structures Around Cold Cathode Emitter Tips Using Chemical Mechanical Polishing Technology." Unfortunately, an insulator reflow process generally involves the use of an extra processing step to lay down an extra insulator layer. Also, the typical reflow dielectric materials employed, e.g., borophosphorus-silicate glass (BPSG), require high processing temperatures to generate the reflow. This fact negatively impacts the thermal budget available in the fabrication sequence.

Thus, what are needed are a structure and method to decouple the gate dielectric, or insulator, thickness and the emitter tip to gate distance. It is further desirable to develop such a structure and method which can be incorporated into large population density field emitter arrays without compromising the responsiveness and reliability of the resulting field emission devices. Likewise, it is desirable to obtain these results through an improved and streamlined manufacturing technique.

SUMMARY OF THE INVENTION

The above-mentioned problems with field emission devices and other problems are addressed by the present invention and will be understood by reading and studying the following specification. A structure and method which accord improved performance are provided.

In particular, an illustrative embodiment of the present invention includes a method for forming a self-aligned gate structure around an electron emitting tip. The method includes forming a cathode on a substrate. The cathode includes an emitter tip. An insulator layer is formed over the cathode and the emitter tip. The insulator is ion etched and a gate is formed on the insulator layer.

In another embodiment, a method of forming a field emission device on a substrate is provided. The method includes forming a cathode emitter tip in a cathode region of the substrate. A gate insulator layer is formed on the emitter tip and the substrate. An ion etch process is used in order to reduce the thickness of the gate insulator layer in the cathode region more rapidly than in the isolation region. Further, the method includes forming a gate on the gate insulator layer and an anode is formed opposing the emitter tip.

In another embodiment, a field emitter array is provided. The field emitter array includes a number of cathodes which are formed in rows along a substrate. A gate insulator is formed along the substrate and surrounds the cathodes. A number of gate lines are formed on the gate insulator. And, a number of anodes are formed in columns orthogonal to and opposing the rows of cathodes. The field emitter array is formed according to a method which includes the following: forming a number of cathode emitter tips in cathode regions of the substrate, forming a gate insulator layer on the emitter tips and the substrate such that forming the gate insulator layer includes ion etching the insulator layer such that the insulator layer is formed thinner around the emitter tips than in an isolation region of the substrate, forming a number of gate lines on the gate insulator layer, and forming a number of anodes opposite the emitter tips.

Thus, an improved structure and method are provided which will allow a smaller distance between the emitter tip and the gate structure without having to decrease the thickness of the gate dielectric which increases capacitance. A smaller emitter tip to gate distance lowers the turn-on voltage which is highly desirable in such areas as beam optics and power dissipation. The improved method and structure include the use of an energetic ion etch. Including the etch process removes portions of the sloped surface of a conformally covered emitter tip more rapidly than the flat portions of the gate isolation layer or surface. The method promotes a streamlined fabrication sequence and yields a structure with improved performance.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims.

DETAILED DESCRIPTION

Figure 1A:
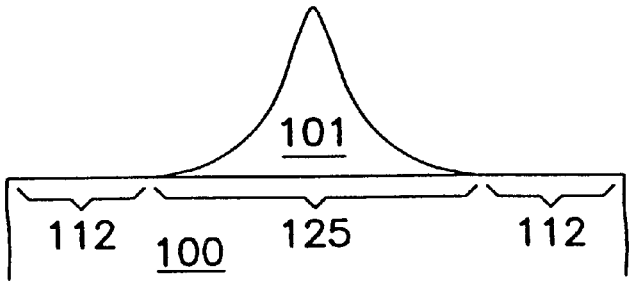
FIGS. 1A–1F illustrate an embodiment of a process of fabrication of a field emission device according to the teachings of the present invention.

In the following detailed description of the invention, reference is made to the accompanying drawings which form a part hereof, and in which is shown, by way of illustration, specific embodiments in which the invention may be practiced In the drawings, like numerals describe substantially similar components throughout the several views. These embodiments are described in sufficient detail to enable those skilled in the art to practice the invention. Other embodiments may be utilized and structural, logical, and electrical changes may be made without departing from the scope of the present invention.

The terms wafer and substrate used in the following description include any structure having an exposed surface with which to form the integrated circuit (IC) structure of the invention. The term substrate is understood to include semiconductor wafers. The term substrate is also used to refer to semiconductor structures during processing, and may include other layers that have been fabricated thereupon. Both wafer and substrate include doped and undoped semiconductors, epitaxial semiconductor layers supported by a base semiconductor or insulator, as well as other semiconductor structures well known to one skilled in the art. The term conductor is understood to include semiconductors, and the term insulator is defined to include any material that is less, electrically conductive than-the materials referred to as conductors. The following detailed description is, therefore, not to be taken in a limiting sets, and the scope of the present invention is defined only by the appended claims, along with the full scope of equivalents to which such claims are entitled.

The term "horizontal" as used in this application is defined as a plane parallel to the conventional plane or surface of a wafer or substrate, regardless of the orientation of the wafer or substrate. The term "vertical" refers to a direction perpendicular to the horizontal as defined above. Prepositions, such as "on", "side" (as in "sidewall"), "higher", "lower", "over" and "under" are defined with respect to the conventional plane or surface being on the top surface of the wafer or substrate, regardless of the orientation of the wafer or substrate.

Figure 1B:
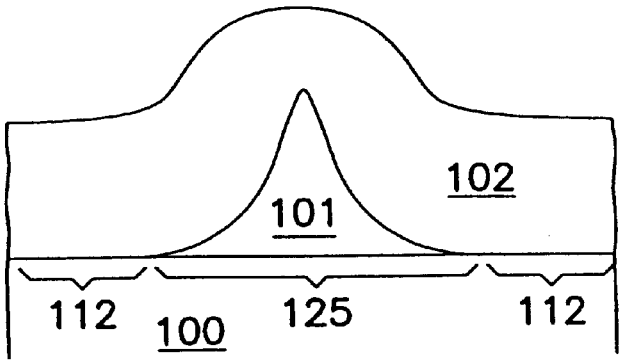
Figure 1C:
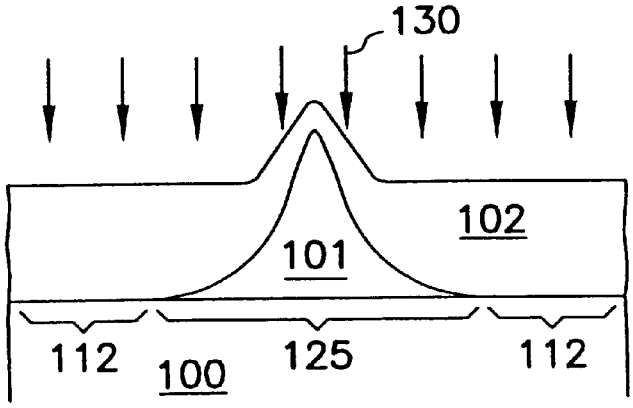
Figure 1D:
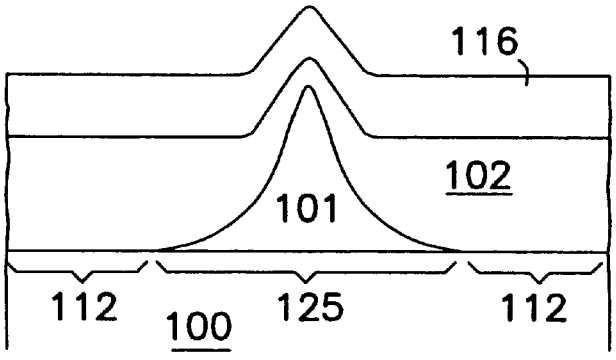
Figure 1E:
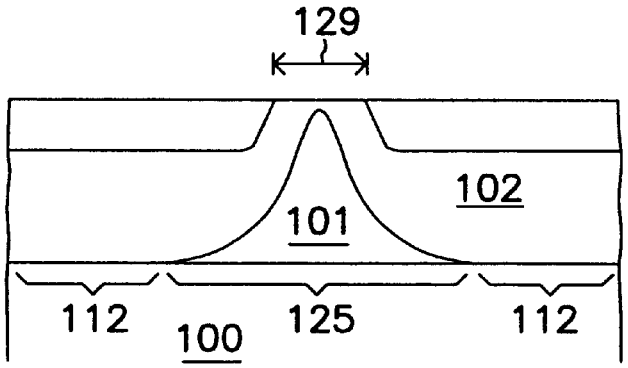
Figure 1F:
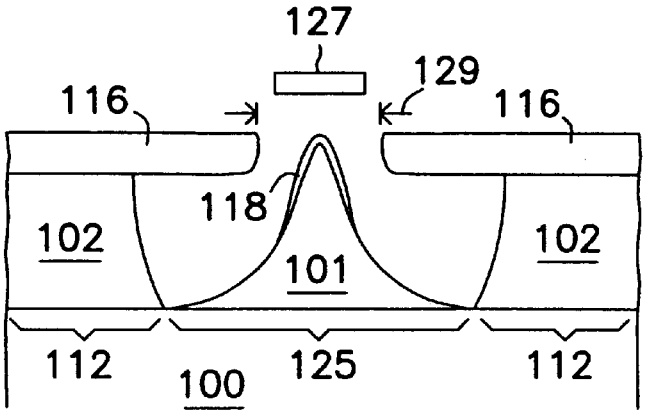

FIGS. 1A–1F illustrate an embodiment of a process of fabrication of a field emission device according to the teachings of the present invention. The field emission device is formed using a self-aligned technique for positioning a gate around cathode emitter tips. In FIG. 1A, a cathode emitter tip 101 is illustrated formed on a substrate 100. In one embodiment the substrate 100 includes a single crystalline silicon layer 100. In an alternative embodiment, the substrate includes an insulator layer formed from glass, wherein glass includes silicon dioxide ($SiO_2$) alone or in combination with other suitable/appropriate elements as understood by one of ordinary skill in the art. The cathode emitter tip 101 is formed in a cathode region 125 of the substrate 100. The cathode emitter tip 101, or emitter tip 101, is formed using any suitable technique such as the method provided in U.S. Pat. No. 5,229,331, entitled "Method to Form Self-Aligned Gate Structures Around Cold Cathode Emitter Tips Using Chemical Mechanical Polishing Technology." The emitter tip 101 is formed as a polysilicon cone 101. In one embodiment, the emitter tip 101 includes a low work function material 118, as shown in FIG. 1F, coated on the emitter tip 101. The low work function material can include forming a metal silicide 118 on the field emitter tip 101. Forming metal silicide 118 will be understood by one of ordinary skill in the art of semiconductor fabrication.

FIG. 1B illustrates the structure following the next sequence of processing steps. In FIG. 1B, a gate insulator layer 102, or insulator layer 102, is formed over the emitter tip 101 and the substrate 100. The insulator layer 102 surrounds the emitter tip 101. The regions of the insulator layer 102 which surround the emitter tip 101 constitute an insulator region 112 for the field emitter device. In one embodiment, the insulator layer 102 includes silicon dioxide ($SiO_2$). In an alternative embodiment, the insulator layer 102 includes silicon nitride ($Si_3N_4$), or any other suitable gate insulator material as recognized by one of ordinary skill in the art. The insulator layer 102 may be formed by any suitable technique as such techniques are understood by those of ordinary skill in the art of semiconductor and field emission device fabrication. One exemplary technique for forming the insulator layer 102 includes chemical vapor deposition (CVD).

FIG. 1C illustrates the device following the next sequence of fabrication steps. In FIG. 1C the insulator layer 102 undergoes an ion etching process. In the ion etching process, the ions impinge on the insulator layer 102 in perpendicular fashion to the insulator 102 surface, as indicated by arrows 130. In one embodiment, the ion etch is performed using an ion gun for sourcing the ions toward the insulator layer 102. Various ion guns, suitable in this process, are commercially available as will by recognized by one of ordinary skill in the art semiconductor and field emission device fabrication. In an alternative embodiment, the ions are plasma generated and become targeted toward the insulator layer 102 upon a proper biasing of the insulator layer 102 and substrate 100. Additionally, any suitable gas may be chosen as the ion source gas in the plasma chamber. In one embodiment, an Oxygen gas is employed. In an alternative embodiment, Argon is utilized as the reactant gas.

The ion etching process serves to reduce the insulator layer 102 thickness more rapidly in the cathode region 125, surrounding the emitter tip 101. The etch rate, using energetic ions, depends not only on the energy of the ions and the nature of the material being etched but also depends highly on the angle at which the ions bombard the surface. The ions impinge at a ninety (90) degree angle relative to the substrate 100. However, as indicated by arrows 130, the ions impinge the surface of the insulator layer 102 in the cathode region 125 at an angle of less than ninety degrees (<90). This is due to the fact that the insulator layer 102 in the cathode region 125 is formed conformal to the cathode emitter tip 101. Thus, in comparison the insulator layer 102 assumes a sloped form over the cathode region 125 and a planar structure in the insulator region 112. The ion bombardment impinging the sloped insulator layer 102 covering the emitter tip 101 reduces the insulator layer 102 thickness over the emitter tip 101 more rapidly than over the planar, insulator regions 112. The insulator layer 102 is etched back in this manner to a desired thickness. In one embodiment, to protect the emitter tip 101 from over etching, a sacrificial buffer layer is deposited over the emitter tip 101 prior to etching. The buffer layer can be either a dielectric layer, such as silicon nitride ($Si_3N_4$), or a conductive layer with a slower etch rate than the insulator layer 102. The structure is now as appears in FIG. 1C.

FIG. 1D illustrates the structure following the next sequence of fabrication steps. A gate, or gate layer 116, is formed on the insulator layer 102. The gate layer 116 includes any conductive layer material and can be formed using any suitable technique. One exemplary technique includes chemical vapor deposition (CVD). In one embodiment the gate layer 116 is formed of doped polysilicon material. In an alternative embodiment, the gate layer 116 is a refractory metal. In this embodiment, the refractory metal can include any one from the selection of molybdenum (Mo), tungsten (W), or Titanium (Ti). Forming the gate layer 116 includes depositing the conductive gate material to a thickness sufficient to cover the entire insulator layer 102 including the portion of the insulator layer 102 above the emitter tip 101.

FIG. 1E illustrates the structure following the next series of processing steps. Following deposition, the gate layer 116 undergoes a removal step using chemical mechanical planarization (CMP). The gate layer 116 is removed using CMP until a portion of the insulator layer 102, covering the emitter tip 101, is revealed. The earlier ion etching step has here resulted in an aperture 129 defined by the gate layer 116 opening above the emitter tip 101. The thickness of the insulator layer 102, between the gate layer 116 and the emitter tip 101 is significantly less than the thickness of the insulator layer 102 extending between the gate layer 116 and the substrate 100.

FIG. 1F illustrates the structure after the next sequence of processing steps. Here, a portion of the insulator layer 102 is removed from surrounding the emitter tip 101. The portion of the insulator layer 102 is removed using any suitable technique as will be understood by one of ordinary skill in the field of semiconductor processing and field emission device fabrication. In one exemplary embodiment, a wet etch is used such as a buffered oxide etch process (BOE), to remove portions of the insulator layer 102. A low work function material 118 can be deposited on the emitter tip 101 at this stage. The low work function material 118 may be deposited using a CVD process. An anode 127 is further formed opposing the emitter tip 101 in order to complete the field emission device. The formation of the anode, and completion of the field emission device structure, can be achieved in numerous ways as will be understood by those of ordinary skill in the art of semiconductor and field emission device fabrication. The formation of the anodes, and completion of the field emission device itself, do not form part of the present invention and as such are not presented in full detail here.

Figure 2:
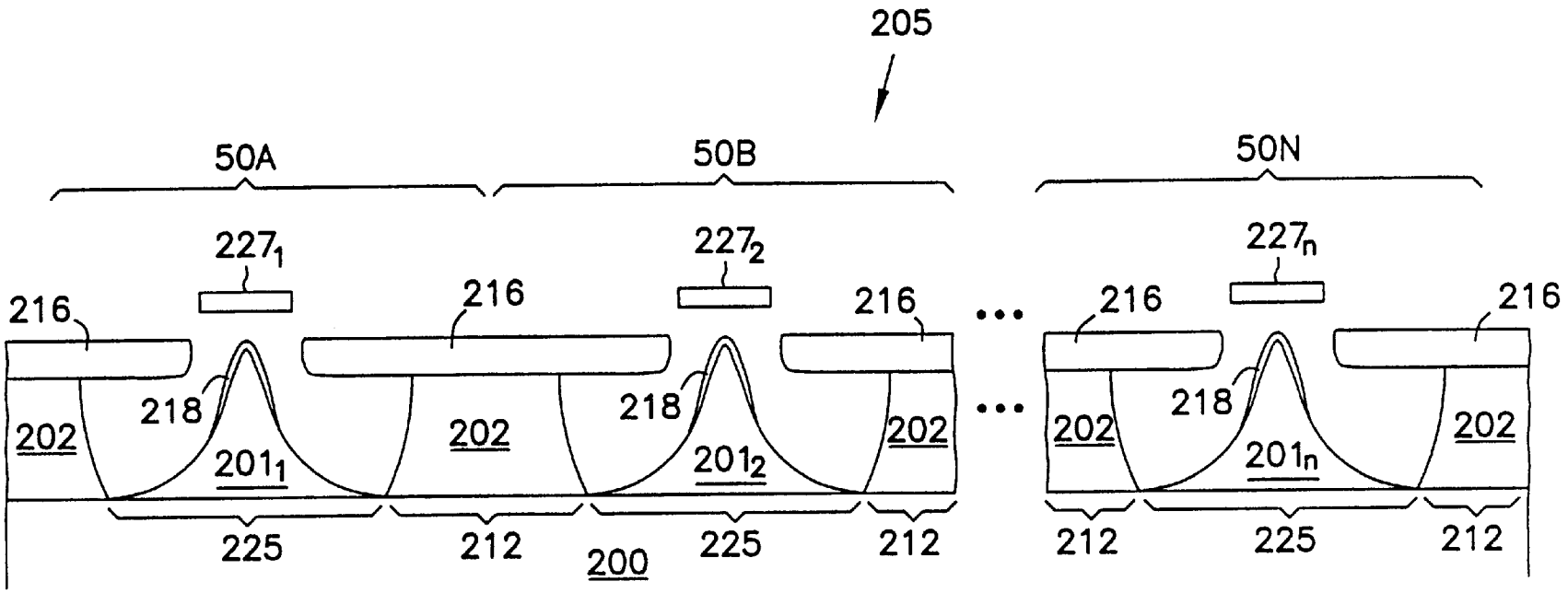
FIG. 2 is a planar view of an embodiment of a portion of an array of polysilicon field emitters according to the teachings of the present invention.

Embodiments of the present invention include the fabrication of a field emitter array which is fabricated according to the method and teachings provided above. FIG. 2 is a planar view of an embodiment of a portion of an array of field emitter devices, 50A, 50B, . . . 50N, each constructed according to the teachings of the present invention. The field emitter array 205 is suited to inclusion in a field emission device. The field emitter array 205 includes a number of cathodes, $\mathbf{201}_1$, $\mathbf{201}_2$, $\mathbf{201}_3$, . . . $\mathbf{201}_n$ formed in rows along a substrate 200. A gate insulator 202 is formed along the substrate 200 and surrounds the cathodes. A number of gate lines 216 are on the gate insulator. A number of anodes, $\mathbf{227}_1$, $\mathbf{227}_2$, $\mathbf{227}_3$, . . . $\mathbf{227}_n$ are formed in columns orthogonal to and opposing the rows of cathodes. The anodes, $\mathbf{227}_1$, $\mathbf{227}_2$, $\mathbf{227}_3$, . . . $\mathbf{227}_n$ include multiple phosphors. And, the intersection of the rows of cathodes, $\mathbf{201}_1$, $\mathbf{201}_2$, $\mathbf{201}_3$, . . . $\mathbf{201}_n$ and columns of anodes, $\mathbf{227}_1$, $\mathbf{227}_2$, $\mathbf{227}_3$, . . . $\mathbf{227}_n$ form pixels.

Each field emitter device in the array, 50A, 50B, . . . , 50N, is constructed in a similar manner. Thus, only one field emitter device 50N is described herein in detail. All of the field emitter devices are formed along the surface of a substrate 200 according to the method presented in connection with FIGS 1A–1F. In one embodiment, the substrate includes a doped silicon substrate 200. In an alternate embodiment, the substrate is a glass substrate 200, including silicon dioxide ($SiO_2$) alone or in combination with other appropriate elements as understood by one of ordinary skill in the art. Field emitter device SON includes a cathode 201 formed in a cathode region 225 of the substrate 200. The cathode 201 includes an emitter tip 201 which is a polysilicon cone 201. In one exemplary embodiment, the polysilicon cone 201 includes a metal silicide 218 on the polysilicon cone 201. The metal silicide 218 can include any one from a number of refractory metals, e.g. molybdenum (Mo), tungsten (W), or titanium (Ti), which has been deposited on the polysilicon cone 201. Formation of the metal silicide 218 includes using the process of chemical vapor deposition (CVD) to deposit the refractory metal, and then, includes a rapid thermal anneal (RTA) to form the silicide. A gate insulator 202 is formed in an isolation region 212 of the substrate 200. The gate insulator 202 includes any suitable insulator material, e.g., silicon dioxide ($SiO_2$) or silicon nitride ($Si_3N_4$). The gate insulator layer 202 is formed conformally to the polysilicon cone 201 by any suitable process such as by CVD. Next the insulator layer 202 undergoes an ion etch process which is explained in detail and presented above in connection with FIGS. 1A–1F. The insulator layer 202 remains only in the isolation regions 212 of the array 205.

The gate 216 is formed on the gate insulator 202. In one embodiment, the gate 216 is formed of doped polysilicon. In an alternate embodiment, the gate 216 is formed of any other suitable conductor material, e.g., a refractory metal or, alternatively doped polysilicon. The gate 216 and the polysilicon cone 201 are formed using a self-aligned technique which is discussed above in connection with fabricating a field emitter device. An anode 227 opposes the emitter tip 201. The separation of the gate 216 and the emitter tip 201 by the insulator layer 202 is significantly thinner than the separation distance of the gate 216 and the substrate 200 by the insulator layer 202. The thinner separation thickness of the insulator layer 202 between the gates 216 and the emitter tips 201 is produced using an ion etch process as described above in connection with FIGS. 1A–1F.

Figure 3:
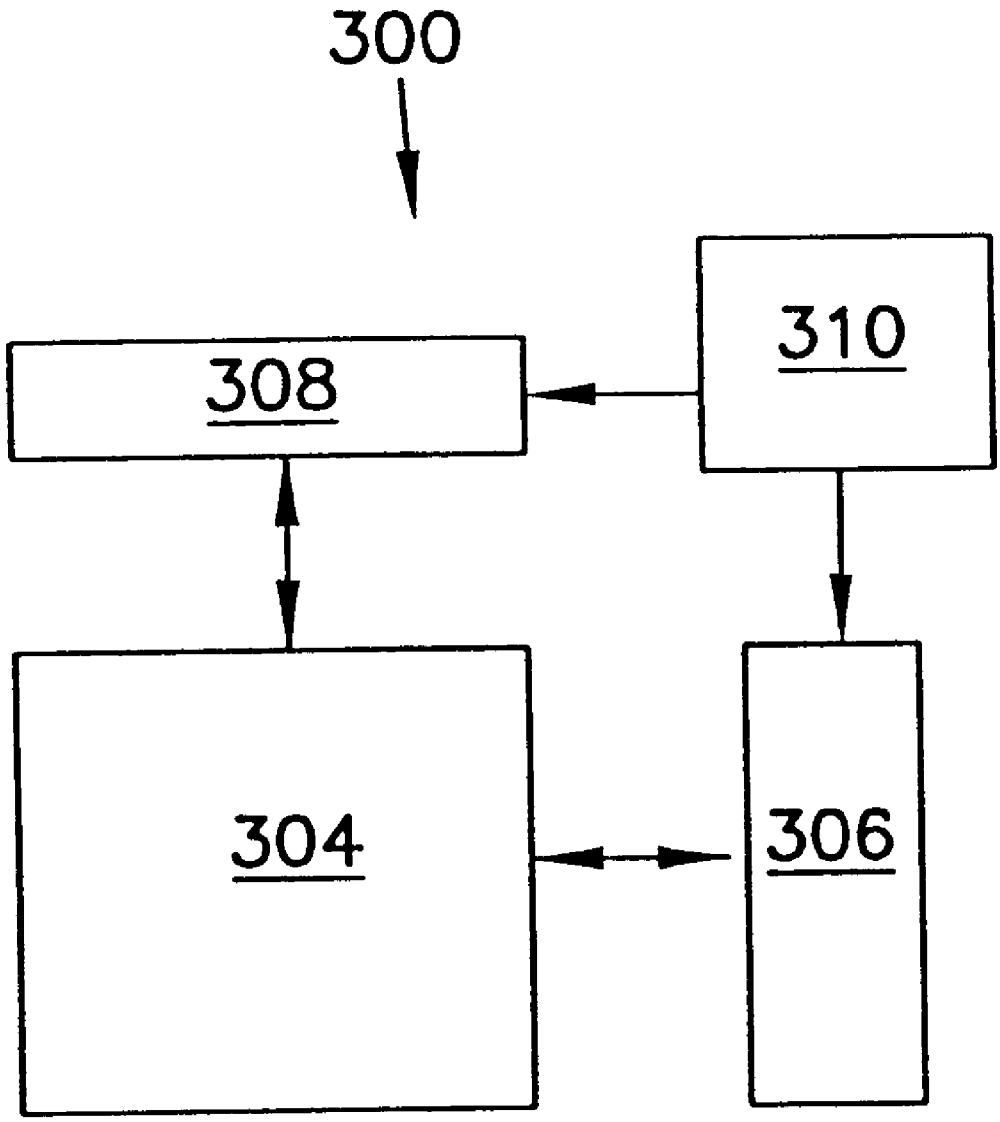
FIG. 3 is a block diagram which illustrates an embodiment of a flat panel display system according to the teachings of the present invention.

FIG. 3 is a block diagram which illustrates an embodiment of a flat panel display system 300 according to the teachings of the present invention. A flat panel display includes a field emitter array 304 formed on a glass substrate. The field emitter array includes the field emitter array described and presented above in connection with FIG. 2. A row decoder 306 and a column decoder 308 each couple to the field emitter array 304 in order to selectively access the array. Further, a processor 310 is included which is adapted to receiving input signals and providing the input signals to address the row and column decoders, 306 and 308 respectively.

CONCLUSION

Thus, an improved structure and method are provided which will allow a smaller distance between the emitter tip and the gate structure. The structure is achieved without having to decrease the thickness of the gate dielectric, or insulator layer, which would carry the negative effect of increased capacitance. A smaller emitter tip to gate distance lowers the turn-on voltage which is highly desirable in such areas as beam optics and power dissipation. The improved method and structure include the use of an energetic ion etch. Including the etch process removes portions of the sloped insulator layer surface of a conformally covered emitter tip more rapidly than flat portions out in the isolation region. This technique avoids the shortcomings and problems of thermal budgets and additional process steps encountered when using reflow techniques. The method promotes a streamlined fabrication sequence and yields a structure with improved performance.

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. It is to be understood that the above description is intended to be illustrative, and not restrictive. Combinations of the above embodiments, and other embodiments will be apparent to those of skill in the art upon reviewing the above description. The scope of the invention includes any other applications in which the above structures and fabrication methods are used. The scope of the invention should be determined with reference to the appended claims, along with the full scope of equivalents to which such claims are entitled.

What is claimed is:

1. A method for forming a self-aligned gate structure around an emitter tip, comprising:

forming a cathode on a substrate, the cathode having an emitter tip;

forming an insulator layer over the cathode and the emitter tip;

ion etching the insulator layer; and forming a gate layer on the insulator layer.

2. The method of claim 1, wherein forming a gate layer includes:

depositing a refractory metal on the insulator layer; and using a chemical mechanical planarization (CMP) process on the refractory metal in order to expose a portion of the insulator layer surrounding the emitter tip.

3. The method of claim 2, wherein the method further includes removing a portion of the insulator layer surrounding the emitter tip in order to uncover the emitter tip.

4. The method of claim 1, wherein ion etching the insulator layer includes using an ion gun as a source of the ions.

5. The method of claim 1, wherein ion etching the insulator layer includes using an Argon plasma ion source.

6. The method of claim 1, wherein ion etching the insulator layer includes using an Oxygen plasma ion source.

7. The method of claim 1, wherein the method further includes coating the emitter tip with a low work function material.

8. The method of claim 1, wherein forming a cathode on a substrate includes forming the cathode on a glass substrate.

9. The method of claim 1, wherein forming a cathode on a substrate includes forming the cathode on a doped silicon material substrate.

10. The method of claim 1, wherein forming a gate layer includes forming a molybdenum (Mo) gate layer.

11. The method of claim 1, wherein forming a gate layer includes forming a tungsten (W) gate layer.

12. The method of claim 1, wherein forming a gate layer includes forming a titanium (Ti) gate layer.

13. A method for forming a self-aligned gate structure around an emitter tip, comprising:

forming a cathode on a substrate, the cathode having an emitter tip;

forming an insulator layer over the cathode and the emitter tip;

ion etching the insulator layer; and forming a gate layer on the insulator layer, wherein forming a gate layer includes;

depositing a refractory metal on the insulator layer; and using a chemical mechanical planarization (CMP) process on the refractory metal in order to expose a portion of the insulator layer surrounding the emitter tip.

14. A method for forming a self-aligned gate structure around an emitter tip, comprising:

forming a cathode on a substrate, the cathode having an emitter tip;

forming an insulator layer over the cathode and the emitter tip;

ion etching the insulator layer using an ion gun as a source of the ions; and forming a gate layer on the insulator layer, wherein forming a gate layer includes;

depositing a refractory metal on the insulator layer; and using a chemical mechanical planarization (CMP) process on the refractory metal in order to expose a portion of the insulator layer surrounding the emitter tip.

15. A method for forming a self-aligned gate structure around an emitter tip, comprising:

forming a cathode on a substrate, the cathode having an emitter tip;

forming an insulator layer over the cathode and the emitter tip;

ion etching the insulator layer using an Argon plasma ion source; and forming a gate layer on the insulator layer, wherein forming a gate layer includes;

depositing a refractory metal on the insulator layer; and using a chemical mechanical planarization (CMP) process on the refractory metal in order to expose a portion of the insulator layer surrounding the emitter tip.

16. A method for forming a self-aligned gate structure around an emitter tip, comprising:

forming a cathode on a glass substrate, the cathode having an emitter tip;

forming an insulator layer over the cathode and the emitter tip;

ion etching the insulator layer using an Argon plasma ion source; and forming a gate layer on the insulator layer, wherein forming a gate layer includes;

depositing a refractory metal on the insulator layer;

using a chemical mechanical planarization (CMP) process on the refractory metal in order to expose a portion of the insulator layer surrounding the emitter tip;

removing a portion of the insulator layer surrounding the emitter tip in order to uncover the emitter tip; and coating the emitter tip with a low work function material.

17. A method of forming a field emission device on a substrate, comprising:

forming a cathode emitter tip in a cathode region of the substrate;

forming a gate insulator layer on the emitter tip and the substrate;

using an ion etch process in order to reduce the thickness of the gate insulator layer in the cathode region more rapidly than in the isolation region;

forming a gate on the gate insulator layer; and forming an anode opposite the emitter tip.

18. The method of claim 17, wherein using an ion etch process to reduce the thickness of the gate insulator layer includes forming a buffer layer on the cathode emitter tip prior to using the ion etch process in order to protect the emitter tip from over etching.

19. The method of claim 18, wherein forming a buffer layer includes forming a dielectric layer of silicon nitride ($Si_3N_4$).

20. The method of claim 17, wherein forming the cathode emitter tip includes forming a polysilicon cone.

21. The method of claim 17, wherein forming the cathode emitter tip includes forming a metal silicide on a polysilicon cone.

22. The method of claim 17, wherein forming a gate includes:

depositing a conductive material on the gate insulator layer; and using a chemical mechanical planarization (CMP) process on the conductive material in order to expose a portion of the gate insulator layer surrounding the emitter tip.

23. The method of claim 17, wherein forming a field emitter device on a substrate includes forming the field emitter device on a glass substrate.

24. The method of claim 17, wherein forming a field emitter device on a substrate includes forming the field emitter device on a doped silicon material substrate.

25. The method of claim 17, wherein forming a gate includes forming a gate from a refractory metal.

26. The method of claim 17, wherein forming a gate includes forming a gate from doped polysilicon.

27. A method of forming a field emission device on a substrate, comprising:

forming a cathode emitter tip in a cathode region of the substrate;

forming a gate insulator layer on the emitter tip and the substrate;

using an ion etch process in order to reduce the thickness of the gate insulator layer in the cathode region more rapidly than in the isolation region;

forming a gate on the gate insulator layer, wherein forming a gate includes;

depositing a conductive material on the gate insulator layer; and using a chemical mechanical planarization (CMP) process on the conductive material in order to expose a portion of the gate insulator layer surrounding the emitter tip; and forming an anode opposite the emitter tip.

28. The method of claim 27, wherein using an ion etch process to reduce the thickness of the gate insulator layer includes forming a buffer layer on the cathode emitter tip prior to using the ion etch process in order to protect the emitter tip from over etching.

29. The method of claim 28, wherein forming a buffer layer includes forming a dielectric layer of silicon nitride ($Si_3N_4$).

30. The method of claim 27, wherein forming the cathode emitter tip includes forming a polysilicon cone.

31. The method of claim 27, wherein forming a field emitter device on a substrate includes forming the field emitter device on a glass substrate.

32. The method of claim 27, wherein forming a field emitter device on a substrate includes forming the field emitter device on a doped silicon material substrate.

33. A method of forming a field emission device on a glass substrate, comprising:

forming a cathode emitter tip in a cathode region of the substrate, wherein forming the cathode emitter tip includes forming a polysilicon cone;

forming a gate insulator layer on the emitter tip and the substrate;

using an ion etch process in order to reduce the thickness of the gate insulator layer in the cathode region more rapidly than in the isolation region, wherein the ion etch process further includes;

forming a dielectric layer of silicon nitride ($Si_3N_4$) on the cathode emitter tip prior to using the ion etch process in order to protect the emitter tip from over etching;

forming a gate on the gate insulator layer, wherein forming a gate includes;

depositing a conductive material on the gate insulator layer; and using a chemical mechanical planarization (CMP) process on the conductive material in order to expose a portion of the gate insulator layer surrounding the emitter tip; and forming an anode opposite the emitter tip.

34. The method of claim 33, wherein depositing a conductive material includes depositing a refractory metal.

35. The method of claim 33, wherein depositing a conductive material includes depositing doped polysilicon.

* * * * *

UNITED STATES PATENT AND TRADEMARK OFFICE

CERTIFICATE OF CORRECTION

PATENT NO. : 6,394,871 B2
DATED : May 28, 2002
INVENTOR(S) : Lee

It is certified that error appears in the above-identified patent and that said Letters Patent is hereby corrected as shown below:

Title page,
Item [56], References Cited, U.S. PATENT DOCUMENTS, delete "SiO2" and insert -- $SiO_2$ --, therefor.

Column 3,
Line 39, after "PRACTICED" insert -- . --.
Line 59, after "less" delete ",".
Line 59, after "than" delete "-".
Line 61, delete "sets" and insert -- sense --, therefor.

Column 4,
Line 59, delete "will by" and insert -- will be --, therefor.

Column 6,
Line 36, delete "SON" and insert -- 50N --, therefor.

Signed and Sealed this

Twenty-ninth Day of October, 2002

*Attest:*

*Attesting Officer*

JAMES E. ROGAN
*Director of the United States Patent and Trademark Office*